US005947695A

United States Patent [19]

Nagaoka et al.

[11] Patent Number: 5,947,695

[45] Date of Patent: Sep. 7, 1999

[54] CONTROL DEVICE FOR A VARIABLE DISPLACEMENT HYDRAULIC PUMP

[75] Inventors: Kou Nagaoka; Kenzo Kimoto, both of Osaka, Japan

[73] Assignee: Komatsu Ltd., Tokyo, Japan

[21] Appl. No.: 08/849,499

[22] PCT Filed: Dec. 8, 1995

[86] PCT No.: PCT/JP95/02527

§ 371 Date: Jun. 5, 1997

§ 102(e) Date: Jun. 5, 1997

[87] PCT Pub. No.: WO96/18039

PCT Pub. Date: Jun. 13, 1996

[30] Foreign Application Priority Data

Dec. 9, 1994 [JP] Japan ..... 6-330899

[51] Int. Cl.[6] ..... F04B 49/00; F16D 31/02

[52] U.S. Cl. ..... 417/213; 417/222.1; 60/450; 60/452

[58] Field of Search ..... 417/213, 222.1, 417/270, 280; 60/449, 450, 452

[56] References Cited

U.S. PATENT DOCUMENTS

| | | | |
|---|---|---|---|
| 3,635,020 | 1/1972 | Mahlmann | 60/450 |
| 4,523,430 | 6/1985 | Masuda | 417/222.1 |
| 5,279,122 | 1/1994 | Shirai et al. | 60/452 |
| 5,784,883 | 7/1998 | Ohkura et al. | 60/449 |

FOREIGN PATENT DOCUMENTS

| | | |
|---|---|---|
| 52-153207 | 12/1977 | Japan . |
| 59-26796 | 6/1984 | Japan . |
| 2-42185 | 2/1990 | Japan . |
| 5-53948 | 8/1993 | Japan . |

*Primary Examiner*—Timothy S. Thorpe
*Assistant Examiner*—Cheryl J. Tyler
*Attorney, Agent, or Firm*—Sidley & Austin

[57] ABSTRACT

The present invention is a control device for a variable displacement hydraulic pump by which the absorption horsepower of the hydraulic pump increases with excellent responsiveness and ON/OFF operations of a cut-off control of the maximum pressure can be selected. To this end, a hydraulic pump (2), a slow return valve (25) and a switching valve (24) placed parallel to each other in a flow path connecting a servo piston (4) and a servo valve (5); a solenoid valve (26), for controlling the pilot pressure of the switching valve (24); and an ON/OFF operation selectable selector (30), connected to a control device (10), are included; and the controlling device (10) outputs a command signal to the solenoid valve (26) when the selector (30) is switched ON to lower the operation speed of the swash plate angle of the hydraulic pump (2).

20 Claims, 3 Drawing Sheets

CONTROL DEVICE FOR A VARIABLE DISPLACEMENT HYDRAULIC PUMP

TECHNICAL FIELD

The present invention relates to a control device for controlling a variable displacement hydraulic pump, which is driven by an engine.

BACKGROUND ART

The conventional control device for a variable displacement hydraulic pump includes a variable displacement hydraulic pump 2 (hereinafter, referred to a hydraulic pump 2) driven by an engine 1, and a pilot pump 3 (for example, refer to Japanese Patent Application Publication No. 5-53948). The hydraulic pump 2 has a swash plate angle, which is controlled by a servo piston 4, and is connected to a servo valve 5 for controlling the operation pressure of the servo piston 4. The servo valve 5 is controlled by a neutral control valve 6 (hereinafter referred to as a NC valve 6), a cut-off valve 7 (hereinafter referred to as a CO valve 7), and a variable torque control valve 8 (hereinafter, referred to as a torque control valve 8), which are connected in series.

A conduit 12*a*, branching from a discharge conduit 12 of the hydraulic pump 2, connects an actuating portion 7*e* of the CO valve 7 and an actuating portion 8*d* of the torque control valve 8 via branch conduits 12*d* and 12*c*, respectively. A conduit 13*a* branching from a discharge conduit 13 of the pilot pump 3 connects to a conduit 13*b*. An engine speed sensor 1*a* for detecting the engine speed of the engine 1 is connected to a control device 10 via an electric circuit 9. The control device 10 is connected to an operating portion 8*c* of the torque control valve 8 via an electric circuit 11.

A direction switching valve 16, connected to the discharge conduit 12, is connected to a hydraulic cylinder 20 via conduits 21*a* and 21*b*, and is connected to a jet sensor (a pressure detecting portion) 17 via a conduit 18. The jet sensor 17 is connected to a drain conduit 19. The discharge conduit 13 is connected to a pressure controller 14, which is equipped with an operating lever 15. The pressure controller 14 is connected to opposite actuating portions of the direction switching valve 16 via conduits 14*a* and 14*b*. 12*b* is a relief valve.

Now, the operation will be explained. The value of the pressure, detected at the jet sensor 17, is inputted via conduit 23 into the operating portion 6*d* at one end of the NC valve 6, and the value of the pressure, detected at the drain conduit 19 at the downstream side of the jet sensor 17, is inputted via conduit 22 into an operating portion 6*c* at the other end. The NC valve 6 is switched by the pressure difference of sites before and after the jet sensor 17. The NC valve 6 is moved to its position 6*b* when the direction switching valve 16 is moved to either of its end operating positions. By placing the direction switching valve 16 at the center valve position as illustrated in the drawing, the entire discharge of the hydraulic pump 2 is drained through the jet sensor 17 and the drain conduit 19 into the sump tank. Therefore, the pressure difference before and after the jet sensor 17 is greater and the NC valve 6 is at its position 6*a* in the drawing.

At this time, the engine speed signal, from the engine speed sensor 1*a*, is inputted into the control device 10, and in response to the engine speed signal, a command signal of the control device 10 is inputted into an actuating portion 8*c* of the torque control valve 8. The discharge pressure of the hydraulic pump 2 is also inputted into the actuating portion 8*d* of the torque control valve 8. When the discharge pressure of the hydraulic pump 2 is low, relative to the command signal of the engine speed, the torque control valve 8 is at its position 8*a* as illustrated in the drawing. When the CO valve 7 is at its position 7*a* and the NC valve 6 is at its position 6*a*, the pilot pressure from the conduit 13*b* is inputted into the actuating portion of the servo valve 5, therefore the servo valve 5 is switched to its position 5*a*. As a result, the servo piston 4 moves toward the left in the direction of an arrow Y, since the oil at the bottom side is drained and the oil from the conduit 13*a* flows into the head side, and the discharge of the pump 2 is increased.

Contrary to the above, when the discharge pressure of the hydraulic pump 2 is high, relative to the command signal of the engine speed, the torque control valve 8 is switched to its position 8*b*. As a result of this switching, the pilot pressure from the conduit 13*b* is not inputted into the actuating portion of the servo valve 5; therefore, the servo valve 5 is switched to its position 5*b*. As a result, the oil from the conduit 13*a* flows into the bottom side of the servo piston 4 and the oil at the head side is drained; therefore, the servo piston 4 moves to the right in the direction of the arrow Y, and decreases the discharge of the pump.

The force of a spring 7*c* is set at high, relative to the discharge pressure of the hydraulic pump 2, so that the CO valve 7 is normally at its position 7*a*. When the hydraulic pump 2 has the maximum pressure, the CO valve 7 is switched to its position 7*b*, so that the cut-off control of the maximum pressure is carried out. In response to the engine speed N and the discharge pressure P of the hydraulic pump 2, the torque control valve 8 controls so that the discharge Q ($Q=q\cdot N$) of the hydraulic pump 2 is constant. The q is discharge per revolution (cc/rev). Accordingly, the absorption horsepower of the hydraulic pump 2 is controlled so as to be on a constant line of equal horsepower ($P\cdot Q=\text{constant}$).

The above-described control device 10 of the hydraulic pump 2 conducts a control to reduce the discharge Q of the hydraulic pump 2 when the load during operation is increased and the discharge pressure P of the hydraulic circuit is risen. Specifically, explaining with reference to FIG. 2, the discharge Q moves on a line A ($P\cdot Q=\text{constant}$). Therefore, the discharge of the hydraulic pump 2 begins to decline in response to the increased load before the engine speed is reduced, so that the speed of the cylinder 20 is reduced and there is a disadvantage of lacking firm responsiveness. Accordingly, when the load is suddenly increased during operation, it is necessary that the absorption horsepower of the hydraulic pump 2 is increased.

In addition, in order to improve the fuel efficiency of the engine 1, when the hydraulic pump 2 reaches the maximum pressure, the control device 10 conducts a cut-off control of the pressure. Explaining with reference to FIG. 4, the discharge pressure P is moved from a point C1 to a line C2 as a result of the cut-off control. When the discharge pressure P is moved to the line C2, matching and relief (relief flow Rq) are conducted at the point C3 with the relief valve property being set at the line R, and the control to minimize the swash plate angle of the hydraulic pump 2 is conducted. With the minimum swash plate angle, there is a disadvantage of lacking sufficient power.

As another control device for the hydraulic pump, a control is known in which a mechanism for delaying the operation of the regulator for controlling the hydraulic pump flow is included, and the delay time is increased or decreased according to the increase or decrease in the engine speed (for example, refer to Japanese Patent Application Publication No. 59-26796).

However, the above control device normally controls the hydraulic pump flow by increasing or decreasing the engine speed; therefore, there is a disadvantage of delaying the response of the swash plate angle of the hydraulic pump when the load is abruptly and repeatedly increased and decreased in a short time during operation.

DISCLOSURE OF THE INVENTION

The present invention is made in order to eliminate the disadvantages of the above-described conventional art, and its object is to provide a control device for a variable displacement hydraulic pump by which the responsiveness to an increase in the absorption horsepower of a hydraulic pump is improved and an ON/OFF operation of a cut-off control of the maximum pressure of the hydraulic pump can be selected.

The control device for a variable displacement hydraulic pump of the present invention is a control device for a variable displacement hydraulic pump equipped with an engine, which comprises: a variable displacement hydraulic pump driven by the engine; a servo piston, for controlling a swash plate angle of the variable displacement hydraulic pump; a servo valve, which is operated by the pressure of a pilot pump and which controls the operation of the servo piston; a neutral control valve, for controlling the operation pressure of the servo valve; a cut-off valve, for conducting a cut-off control of the maximum pressure of the variable displacement hydraulic pump; and a variable torque control valve; and the control device is characterized by including:

a slow return valve and a switching valve placed in parallel to each other in a flow path connecting the servo piston and the servo valve; a solenoid valve, for controlling the pilot pressure switching the switching valve; and a selector which is connected to the control device and which allows a selection of an ON operation or an OFF operation; and is further characterized by the control device outputting a command signal to the solenoid valve when the selector is switched ON to lower the operating speed for changing the swash plate angle of the variable displacement hydraulic pump.

When the selector is in the ON position, the control device can interlock, can output a command signal to the solenoid valve, can cause the pilot pressure to act on an actuating portion included in the cut-off valve, and can cause the cut-off control to be stopped.

According to the above-described structure, when the load is increased during operation and the discharge pressure of the hydraulic pump is risen, the speed for reducing the swash plate angle of the hydraulic pump can be lowered. As a result, the absorption horsepower of the hydraulic pump is increased in response to the diagonally shaded areas between the line A and a line B (the indicating, means in an OFF state) as illustrated in, for example, FIG. 2. With reference to, for example, FIG. 3, this absorption horsepower is increased, moving on the torque line by switching ON (for example, a point A2) from the matching point A1 in an OFF condition, and can be increased in an range up to the greatest torque point T1 of the engine. Specifically, the absorption horsepower can be increased until the time just before the engine breaks down when the horsepower is over the greatest torque point T1. As a result, even if the load is abruptly increased during operation, the firmness of the responsiveness is increased; therefore, the operability is improved. In addition, an ON/OFF operation of the selector can be selected at will, therefore the increase and decrease of the swash plate angle can be controlled at a normal specified speed by switching OFF as necessary.

When the ON operation of the selector is selected, the maximum pressure of the hydraulic pump is cut off, and the fuel efficiency of the engine can be obtained. On the other hand, when the OFF operation is selected, the fuel efficiency is not improved since the cut-off control function is stopped, but the power is increased and the required operation can be carried out.

BEST MODE FOR CARRYING OUT THE INVENTION

Figure 5:
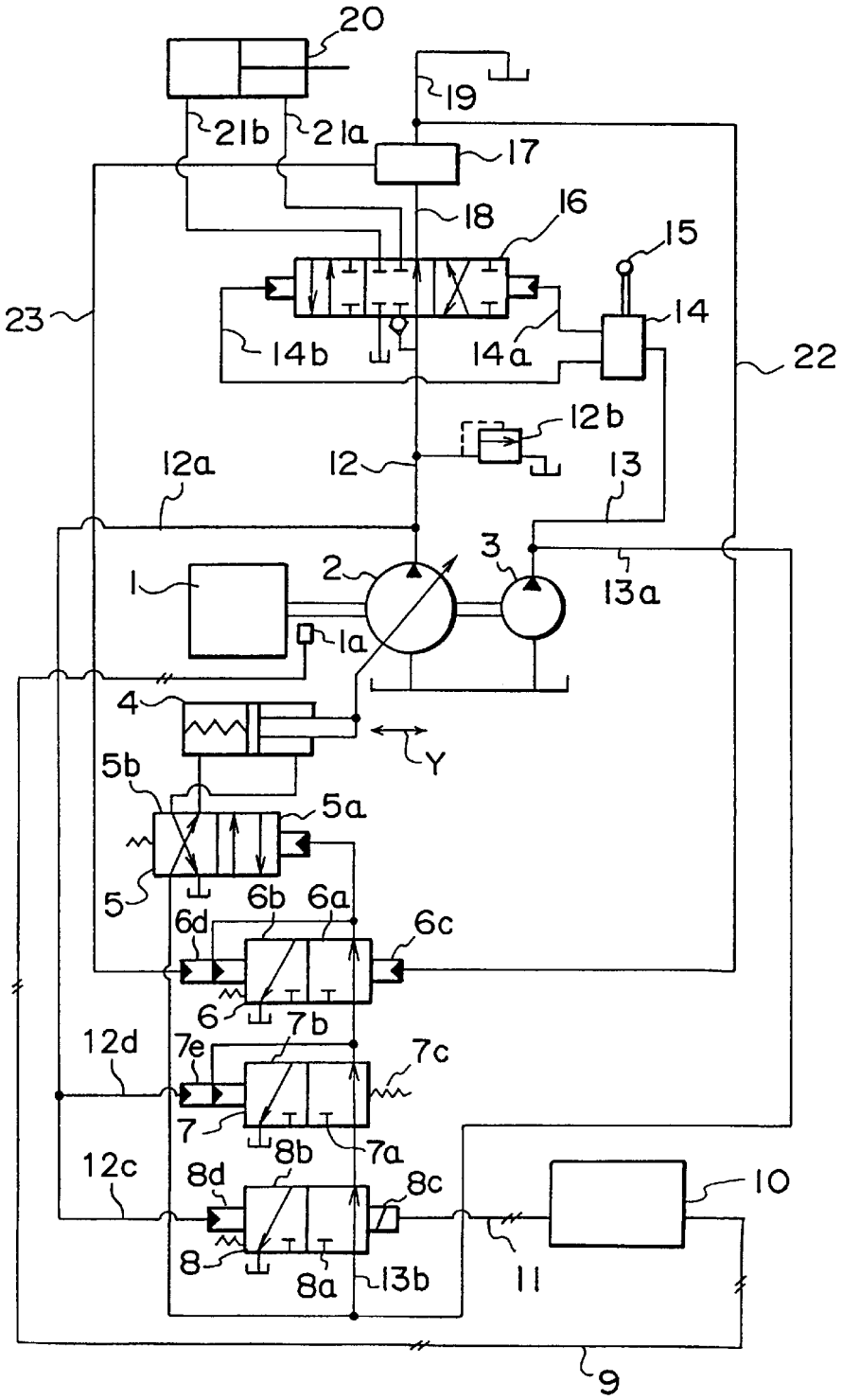
FIG. 5 CONVENTIONAL ART
FIG. 5 is a diagram of a hydraulic circuit of a control device for a variable displacement hydraulic pump relating to the conventional art.

A preferred embodiment of a control device for a variable displacement hydraulic pump relating to the present invention will be particularly described with reference to the attached drawings. The elements of FIG. 1 which are common to FIG. 5 have been given the same reference characters and a detailed description thereof is omitted.

Figure 1:
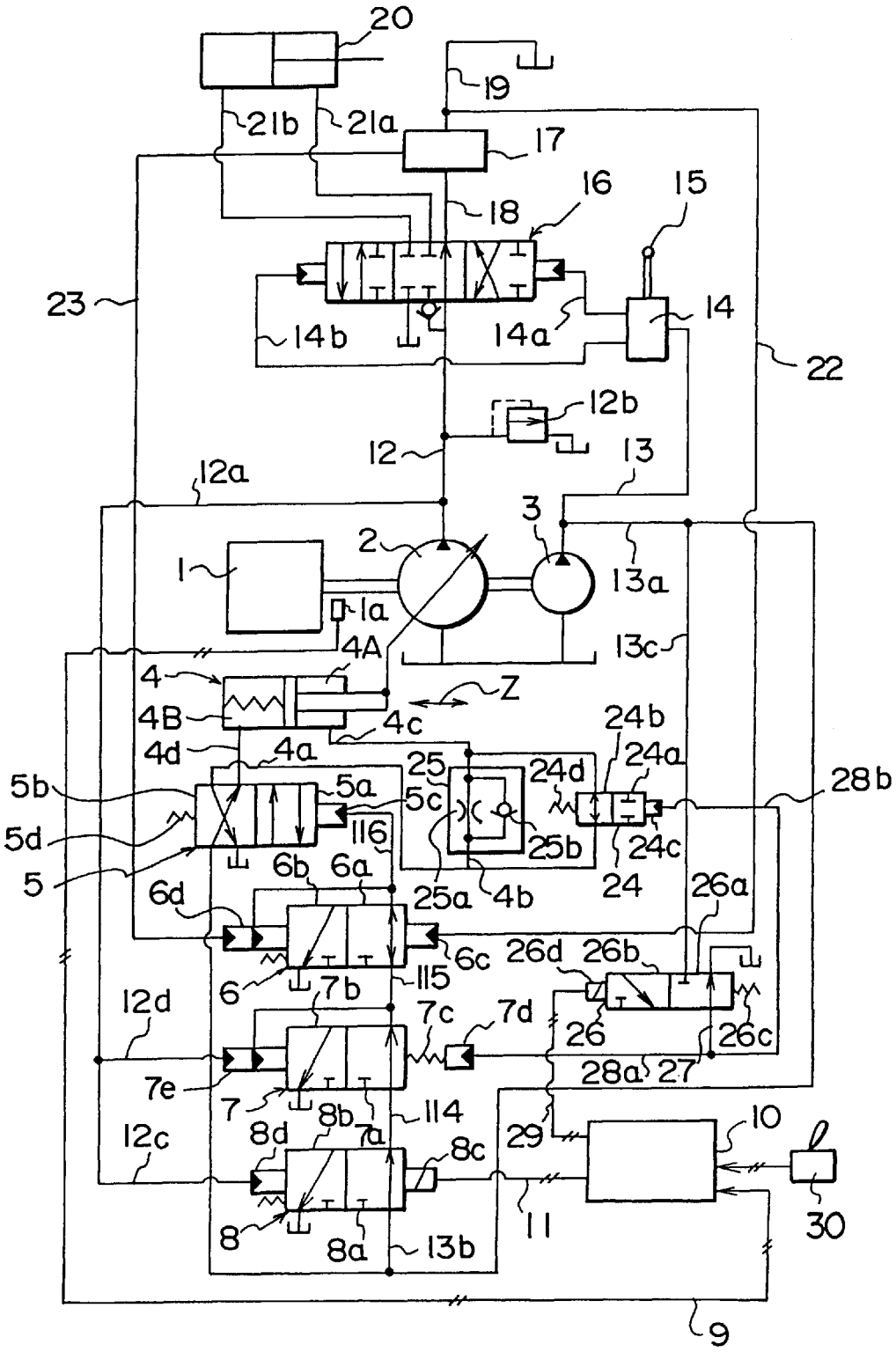
FIG. 1 is a diagram of a hydraulic circuit of a control device for a variable displacement hydraulic pump relating to an embodiment of the present invention.

In FIG. 1, a switching valve 24 is provided between conduits 4*a* and 4*c* connecting the servo valve 5 and the servo piston 4. A slow return valve 25 is provided in a conduit 4*b*, which branches from the conduit 4*a*. The switching valve 24 and the slow return valve 25 are provided parallel to each other between the servo valve 5 and the servo piston 4. The conduit 4*a* and the branching conduit 4*b* are connected to the head chamber 4A of the servo piston 4 via the conduit 4*c*. The servo valve 5 is connected to the bottom chamber 4B of the servo piston 4 via a conduit 4*d*.

The pilot pump 3 is connected to a solenoid valve 26 via a conduit 13*c*, which branches from a conduit 13*a*. The solenoid valve 26 is connected to a pressing member (actuating portion) 7*d* for the spring 7*c* of the CO valve 7 via a conduit 27 and a conduit 28*a*, which branches from the conduit 27. A conduit 28*b*, which branches from the conduit 27, is connected to an actuating portion 24*c* of the switching valve 24.

The engine speed signal of the engine speed sensor 1*a* is inputted into the control device 10 via the electric circuit 9. The signal of an external selector 30 is also inputted into the control device 10. A command signal from the control device 10 is inputted via the electrical circuit 11 into the actuating portion 8*c* of the torque control valve 8 and via an electrical circuit 29 circuit 29 into an actuating portion 26*d* of the solenoid valve 26.

Regarding the operation of the above-described structure, the operation of the servo valve 5, the servo piston 4, the slow return valve 25, the switching valve 24 and the solenoid valve 26 will be explained. Additionally, when the operation is started, the NC valve 6 is at its position 6*a*, the CO valve 7 is at its position 7*a*, and the torque control valve 8 is at its position 8*a*. The pilot pressure of a pilot pump 3 passes through conduits 13*a*, 13*b*, 114, 115, and 116, and acts on an actuating portion 5*c* of the servo valve 5. The servo valve 5 can be switched to its position 5*a* or its position 5*b*, depending on the difference of the force of the pilot pressure acting on the actuating portion 5*c* and the force of a spring 5*d* provided at the other end of the servo valve 5.

The servo valve 5 in FIG. 1 shows the case in which the force of the spring 5*d* is larger than the force of the pilot pressure, and the servo valve 5 is at its position 5*b*. When the servo valve 5 is at its position 5*b*, the pressurized oil discharged from the pilot pump 3 flows into the conduit 4*d* from the branch conduit 13*a* via the servo valve 5. In this condition, the selector 30 is OFF, and the solenoid valve 26 is at its position 26*a*, due to the biasing force of spring 26*c*, since the command signal from the control device 10 is not inputted. Accordingly, since the switching valve 24, on which the pilot pressure does not act, is at its position 24*b* (the open position) as illustrated in the drawing, the oil in the head chamber 4A passes through the conduit 4*c*, the position 24*b* of the switching valve 24, and the conduit 4*a*, and drains into the sump tank. As a result, the servo piston 4 moves toward the right in the direction of the arrow Z, reduces the swash plate angle of the hydraulic pump 2, and conducts a control to reduce the discharge of the hydraulic pump 2.

Contrary to the above, when the force of the pilot pressure is greater than the force of the spring 5*d*, the servo valve 5 is switched to its position 5*a*. At this time, the pressurized oil, discharged from the pilot pump 3, flows into the conduit 4*a* from the branch conduit 13*a* via the servo valve 5. In this condition, the selector 30 is OFF, and the solenoid valve 26 is at its position 26*a* due to the force of spring 26*c* as in the above. Accordingly, the pilot pressure does not act on the switching valve 24, and the switching valve 24 is at its position 24*b* illustrated in the drawing; therefore, the pressurized oil passes through the conduits 4*a* and 4*b*, the check valve 25*b*, the open position 24*b* of the switching valve 24, and the conduit 4*c*, and flows into the head chamber 4A. As a result, the servo piston 4 moves to the left in the direction of the arrow Z, increases the swash plate angle of the hydraulic pump 2, and increases the discharge of the hydraulic pump 2.

The operation of the entire control device of the hydraulic pump 2 following the above-described operation is as follows. When a discharge pressure P of the hydraulic pump 2 rises, the pressure which has risen acts on the actuating portion 8*d* of the torque control valve 8, and at this time, the command signal from the control device 10 is inputted into the actuating portion 8*c* of the torque control valve 8 according to the signals of the engine speed. The control is carried out so that P·Q=constant as described in the above as the discharge pressure P rises; therefore, the pilot pressure flowing from the conduit 13*b* is controlled by the torque control valve 8 in order to remain high. As a result, the high pilot pressure passes through the conduits 13*b*, 114, 115, and 116, and acts on the actuating portion 5*c* of the servo valve 5. The servo valve 5 is controlled between its position 5*b* and its position 5*a* so as to maintain a balance between the force of the high pilot pressure and the force of the spring 5*d*; thereby controlling the absorption horsepower of the hydraulic pump 2.

In such a state, when the selector 30 is operated to be ON, the solenoid valve 26 is switched to its position 26*b* by the command signal from the control device 10. As a result of this switching, the pilot pressure passes through the conduits 13, 13*a*, and 13*c*, the position 26*b* of the solenoid valve 26, and the conduits 27 and 28*b*, the pilot pressure acts on the actuating portion 24*c* of the switching valve 24, and the switching valve 24 is switched to its closed position 24*a*.

Figure 2:
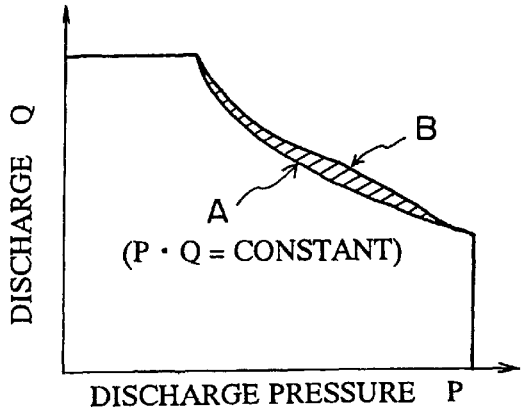
FIG. 2 is a graph showing the relationship between the pressure and flow of the hydraulic pump relating to the embodiment.
Figure 3:
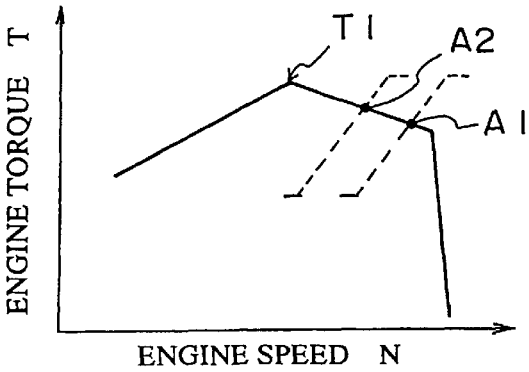
FIG. 3 is a graph showing the relationship among the engine speed, the engine torque, and the absorption horsepower of the hydraulic pump relating to the embodiment.

Accordingly, the pressurized oil from the pilot pump 3 passes through the conduit 13*a*, the servo valve 5, and the conduit 4*d*, and flows into the bottom chamber 4B of the servo piston 4. As a result of the flowing oil, the servo piston 4 tries to move to the right in the direction of the arrow Z, but the oil in the head chamber 4A passes through a throttle 25*a* of the slow return valve 25, and drains from the conduit 4*a* to the sump tank; therefore, the servo piston 4 slowly moves in the right direction. Accordingly, the speed for reducing the swash plate angle of the hydraulic pump 2 is lowered. As a result of this lowered speed, the diagonally shaded areas from the line A (P·Q=constant) to the line B illustrated in FIG. 2 becomes the amount of increased horsepower. Explaining with reference to FIG. 3, the absorption horsepower of the hydraulic pump 2 is increased, moving on the torque line from the matching point A1 in a condition in which the selector 30 is OFF to the point A2 by operating the selector 30 to be ON.

On the other hand, when the indication means 30 is turned OFF, the solenoid valve 26, to which the command signal is not inputted from the control device 10, is switched to its position 26*a*. By being switched like this, the switching valve 24 is at its open position 24*b*, and the oil in the head chamber 4A passes through the switching valve 24 and drains into the sump tank; therefore, the swash plate angle of the hydraulic pump 2 decreases at a specified speed.

As in the above, by turning ON or OFF the selector 30, a choice can be made between the reduction speed of the swash plate angle of the hydraulic pump 2 being lowered and the reduction speed of the swash plate angle of the hydraulic pump 2 being a specified speed.

Figure 4:
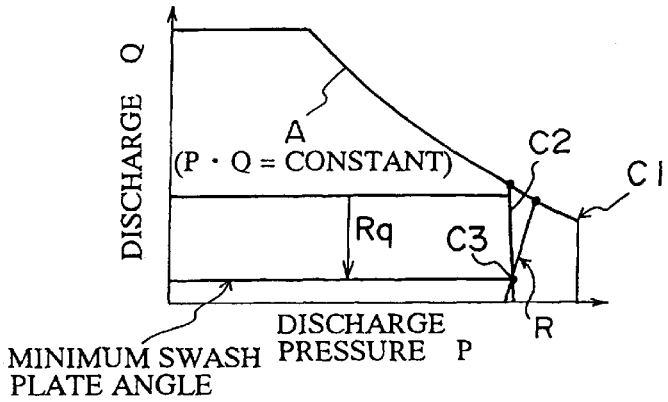
FIG. 4 is a graph explaining a cut-off control relating to the embodiment.

Now, the cut-off control will be explained. When the selector 30 is switched ON, the solenoid valve 26 is switched to its position 26*b* by the command signal from the control device 10, and the pilot pressure passes through the conduits 13, 13*a*, and 13*c*, the solenoid valve 26, and the conduits 27 and 28*a*, and acts on the pressing member 7*d* of the CO valve 7. In this state, even if the discharge pressure of the hydraulic pump 2 reaches the maximum pressure, the CO valve 7 remains at its position 7*a*, so that the cut-off function is stopped and the discharge pressure moves on the line A (P·Q=constant) illustrated in FIG. 4 and reaches the point C1. As a result, the absorption horsepower of the hydraulic pump 2 before the discharge pressure relief becomes greater. Specifically, explaining with FIG. 3, by switching ON the selector 30, the absorption horsepower moves from the matching point A1 of the absorption horsepower at the time when the selector 30 is OFF to the point A2 on the torque line, and the absorption horsepower is increased.

On the other hand, when the selector 30 is OFF, the solenoid valve 26 is switched to its position 26*a*, and the pilot pressure does not act on the pressing member 7*d*. In addition, the pilot pressure does not act on the switching valve 24; therefore, the solenoid valve 26 and the switching valve 24 are in the condition illustrated in FIG. 1. Then, when the discharge pressure P of the hydraulic pump 2 reaches a specified high pressure, the CO valve 7 is at its position 7*b* against the spring 7*c*. As a result, the pilot pressure acting on the actuating portion 5*c* of the servo valve 5 passes through the conduits 116 and 115, and drains into the sump tank. Since the servo valve 5 is switched to its position 5*b*, the pressurized oil from the pilot pump 3 passes through the servo valve 5 and the conduit 4*d*, and flows into the bottom chamber 4B. In addition, the oil in the head chamber 4A passes through the conduit 4*c*, the open position 24*b* of the switching valve 24, the conduit 4*b*, and is drained, so that the servo piston 4 moves to the right (reduction of the discharge Q). As a result, the discharge Q moves from the point C1 on the line A illustrated in FIG. 4 to the line C2; then the swash plate angle of the hydraulic pump 2 is reduced up to the point C3, and the cut-off control is conducted.

As in the above, by including the selector 30 which interlocks the control of the reduction speed of the swash plate angle of the hydraulic pump 2 with the stoppage of the cut-off control, a hydraulic pump control which is the most suitable for an actual operation can be conducted.

Industrial Availability

The present invention is useful as a control device for a variable displacement hydraulic pump by which the operability is improved with the absorption horsepower of the hydraulic pump being rapidly increased in response to the increase of the load during operation, and by which the improvement of the operability or the improvement of the fuel efficiency can be selected by selecting the actuation of the cut-off control or the stoppage of the same.

We claim:

1. A control apparatus for a variable displacement hydraulic pump equipped with an engine (1), comprising a variable displacement hydraulic pump (2), which is driven by said engine (1); a servo piston (4), for controlling a swash plate angle of said variable displacement hydraulic pump (2); a servo valve (5), which is operated by the pressure of a pilot pump (3) and controls the operation of said servo piston (4); a neutral control valve (6), for controlling the operation pressure of said servo valve (5); a cut-off valve, for conducting a cut-off control of a maximum pressure of said variable displacement hydraulic pump (2); a variable torque control valve (8), and a control device (10); said control apparatus comprising:

a slow return valve (25) and a switching valve (24) which are placed parallel to each other in a flow path connecting said servo piston (4) and said servo valve (5);

a solenoid valve (26), for controlling the pilot pressure switching said switching valve (24); and a selector (30) which is connected to said control device (10) and which allows a selection of an ON operation or an OFF operation, said control device (10) outputting a command signal to said solenoid valve (26) when said selector (30) conducts an ON operation to lower the operation speed for changing the swash plate angle of said variable displacement hydraulic pump (2).

2. The control apparatus for a variable displacement hydraulic pump according to claim 1, wherein said control device (10) interlocks when said selector (30) is in said ON operation, outputs a command signal to said solenoid valve (26), causes the pilot pressure to act on an actuating portion **(7*d*) included in said cut-off valve (7)**, and causes said cut-off control to be stopped.

3. An apparatus comprising:

an engine;

a variable displacement hydraulic pump which is driven by said engine;

a servo piston for controlling a swash plate angle of said variable displacement hydraulic pump;

a source of pilot pressure;

a servo valve which is operated by the pilot pressure and which controls the operation of said servo piston;

a slow return valve;

a switching valve, said slow return valve and said switching valve being connected in parallel with each other between said servo piston and said servo valve for passing pressurized oil between said servo piston and said servo valve;

a control device; and a selector, which allows a selection of an ON operation or an OFF operation, said selector being connected to said control device whereby said control device outputs a command signal, when said selector conducts an ON operation, which causes an actuation of said switching valve.

4. An apparatus in accordance with claim 3, wherein said slow return valve comprises a throttle and a check valve connected in parallel with each other.

5. An apparatus in accordance with claim 3, further comprising a solenoid valve, and wherein when said selector is in said ON operation, said control device outputs a command signal to said solenoid valve to cause a pilot pressure to act on an actuating portion of said switching valve to close said switching valve.

6. An apparatus in accordance with claim 5, wherein a closing of said switching valve reduces an operation speed of changing the swash plate angle of said variable displacement hydraulic pump.

7. An apparatus in accordance with claim 5, wherein said switching valve includes a spring for biasing said switching valve to its open position.

8. An apparatus in accordance with claim 3, further comprising a cut-off valve connected between said source of pilot pressure and said servo valve, and a conduit connecting said variable displacement pump to an actuating portion of said cut-off valve for applying a pressure of said variable displacement pump to said actuating portion of said cut-off valve, whereby said cut-off valve can be actuated to conduct a cut-off control of the maximum pressure of said variable displacement hydraulic pump.

9. An apparatus in accordance with claim 8, further comprising a solenoid valve, and wherein when said selector is in said ON operation, said control device outputs a command signal to said solenoid valve to cause a pilot pressure to act on an actuating portion of said cut-off valve to thereby cause said cut-off control to be stopped.

10. An apparatus in accordance with claim 9, wherein when said selector is in said ON operation, said control device outputs a command signal to said solenoid valve to cause a pilot pressure to act on an actuating portion of said switching valve to close said switching valve.

11. An apparatus in accordance with claim 10, wherein said switching valve is spring biased to an open position, and wherein said command signal to said solenoid valve causes said solenoid valve to apply a pilot pressure to said switching valve to actuate said switching valve to a closed position.

12. An apparatus in accordance with claim 11, wherein said slow return valve comprises a throttle and a check valve connected in parallel with each other.

13. An apparatus in accordance with claim 12, further comprising:

a neutral control valve for controlling an operation pressure of said servo valve; and a variable torque control valve;

wherein said neutral control valve, said cut-off valve, and said variable torque control valve are connected in series between said source of pilot pressure and an actuating portion of said servo valve.

14. An apparatus in accordance with claim 13, wherein a conduit passes pressurized oil from said variable displacement hydraulic pump to a first actuating portion of said variable torque control valve, and wherein said control device applies a command signal to a second actuating portion of said variable torque control valve.

15. An apparatus in accordance with claim 14, further comprising a speed sensor for sensing a speed of said engine and for applying a speed signal to said control device.

16. An apparatus in accordance with claim 15, further comprising:

an actuator;

a direction switching valve connected between said variable displacement hydraulic pump and said actuator for passing pressurized oil from said variable displacement hydraulic pump to said actuator, said direction switching valve having a neutral position and first and second operating positions;

a controller for controlling the position of said direction switching valve;

a jet sensor connected between the neutral position of said direction switching valve and an oil sump tank for sensing a pressure upstream of said jet sensor and a pressure downstream of said jet sensor;

a conduit for applying the pressure upstream of said jet sensor to a first actuating portion of said neutral control valve; and a conduit for applying the pressure downstream of said jet sensor to a second actuating portion of said neutral control valve.

17. An apparatus in accordance with claim 3, further comprising:

a neutral control valve for controlling an operation pressure of said servo valve;

a cut-off valve for conducting a cut-off control of a maximum pressure of said variable displacement hydraulic pump;

a variable torque control valve; wherein said neutral control valve, said cut-off valve, and said variable torque control valve are connected in series between said source of pilot pressure and an actuating portion of said servo valve; and a conduit for passing pressurized oil from said variable displacement hydraulic pump to a first actuating portion of said variable torque control valve;

wherein said control device applies a command signal to a second actuating portion of said variable torque control valve.

18. An apparatus in accordance with claim 17, further comprising a speed sensor for sensing a speed of said engine and for applying a speed signal to said control device.

19. An apparatus in accordance with claim 18, further comprising:

an actuator;

a direction switching valve connected between said variable displacement hydraulic pump and said actuator for passing pressurized oil from said variable displacement hydraulic pump to said actuator, said direction switching valve having a neutral position and first and second operating positions;

a controller for controlling the position of said direction switching valve;

a jet sensor connected between the neutral position of said direction switching valve and an oil sump tank for sensing a pressure upstream of said jet sensor and a pressure downstream of said jet sensor;

a conduit for applying the pressure upstream of said jet sensor to a first actuating portion of said neutral control valve; and a conduit for applying the pressure downstream of said jet sensor to a second actuating portion of said neutral control valve.

20. An apparatus in accordance with claim 3, further comprising:

a neutral control valve for controlling an operating pressure of said servo piston;

an actuator;

a direction switching valve connected between said variable displacement hydraulic pump and said actuator for passing pressurized oil from said variable displacement hydraulic pump to said actuator, said direction switching valve having a neutral position and first and second operating positions;

a controller for controlling the position of said direction switching valve;

a sensor connected between the neutral position of said direction switching valve and an oil sump tank for sensing a pressure upstream of said jet sensor and a pressure downstream of said sensor;

a conduit for applying the pressure upstream of jet sensor to a first actuating portion of said neutral control valve; and a conduit for applying the pressure downstream of said sensor to a second actuating portion of said neutral control valve.

* * * * *